United States Patent [19]

Lapshev et al.

[11] 4,210,276

[45] Jul. 1, 1980

[54] CENTRIFUGAL FLUID CLEANER

[76] Inventors: Igor M. Lapshev, ulitsa 20 let VLKSM, 21, kv. 13; Nikolai A. Khodosov, Oktyabrsky poselok, 6 linia, 36; Viktor A. Berber, Shelkovichnaya ulitsa, 184, kv. 65, all of Saratov, U.S.S.R.

[21] Appl. No.: 909,991

[22] Filed: May 26, 1978

[51] Int. Cl.[2] ..... B04B 11/02

[52] U.S. Cl. ..... 233/31; 233/46

[58] Field of Search ..... 233/27, 28, 29, 30, 233/31, 37, 43, 45, 40, 46

[56] References Cited

U.S. PATENT DOCUMENTS

| | | | |
|---|---|---|---|
| 3,931,927 | 1/1976 | Hengstebeck | 233/31 |
| 3,967,777 | 7/1976 | Canevari | 233/31 |
| 3,971,510 | 7/1976 | Frederick | 233/27 |
| 4,161,275 | 7/1979 | Berber | 233/31 |

*Primary Examiner*—Robert W. Jenkins
*Attorney, Agent, or Firm*—Haseltine, Lake & Waters

[57] ABSTRACT

A centrifugal fluid cleaner consists of a vertical hollow shaft fixed rigidly to a base and provided with conduits for the supply and removal of fluid in the upper part of the shaft and a cylindrical rotor rotatably mounted on the hollow shaft. The rotor comprises a casing accommodating an inside sleeve installed coaxially with the hollow shaft and carrying a band coiled around the sleeve in a helical manner, spacers, installed between adjacent turns of the helical band so as to form a plurality of slots within the helical band to permit passage of the fluid, and impellers installed at both ends of the sleeve so that the lower impeller is located in a bottom cavity communicating with the fluid inlet conduit in the hollow shaft and the upper one in a chamber communicating with the fluid outlet conduit in the hollow shaft. The inlet conduit in the hollow shaft is connected with the cavity accommodating the lower impeller through an additional cavity formed between the casing and chamber wall and through an annular duct formed between the casing and peripheral turn of the helical band.

4 Claims, 2 Drawing Figures

CENTRIFUGAL FLUID CLEANER

APPLICATION FIELD OF THE INVENTION

The present invention relates to the apparatus for cleaning liquid fluid and more particularly to the centrifugal fluid cleaners.

The most preferable application of the centrifugal fluid cleaner made according to this invention lies in the purification or reclaiming of fluids (oil, fuel, detergent liquids, etc.) polluted with solid particles.

BACKGROUND OF THE INVENTION

Known in the art is a centrifugal fluid cleaner comprising a vertical stationarily attached hollow shaft provided with conduits for the supply and removal of fluid. Mounted on the shaft through the medium of friction bearings is a cylindrical rotor which comprises a casing, a sleeve with a helical band attached thereto, lower and upper impellers arranged under and above the helix, respectively.

A number of equispaced spacers are installed parallel to the hollow shaft between adjacent turns of the helix in a radial array to form axial slots within the helical band. The mixture of fluid and solid particles is caused to enter the slots through cavities formed between the lower impeller disk and respective end face of the helical band, said cavities communicating with the shaft interior space via holes in the said shaft.

Under the effect of centrifugal force the solid particles are separated from the fluid, being thrown onto the band surfaces.

The purified fluid is drawn from the slots into a chamber formed between the casing upper wall and the top end face of the helical band, accomodating a pressure disk and upper impeller and communicating with the outlet conduit in the hollow shaft.

The separation of solid particles of any size from the polluted fluid in a centrifugal cleaner of such design takes place only in the slots of the helical band, which causes clogging of the slots with sludge, if the contents of contaminants is high, with a resultant deterioration of the efficiency of the purification process. To remove accumulated sludge, it is necessary to strip the cleaner into the component parts and wash the latter. In the above described centrifugal cleaner air is trapped in the upper part when the cleaner is being primed with fluid. It is mandatory to bleed that air prior to starting the cleaner, for which purpose a plugged hole is provided in the uppermost part of the casing. The air bleeding operation complicates preparation of the cleaner for service run.

OBJECTS AND SUMMARY OF THE INVENTION

One important object of the present invention is to provide a centrifugal fluid cleaner with a modified communication of the inlet conduit in the hollow shaft with the lower cavity of the cylindrical rotor, wherein preliminary separation of solid particles from the fluid is effected before the polluted fluid is admitted into the slots of the helical band.

Another object of the present invention is to simplify the operation and maintenance of the centrifugal cleaner.

Yet another object of the present invention is to increase the operation time of the centrifugal cleaner, limited by the necessity of sludge removal.

These and other objects of the present invention have been accomplished by providing a centrifugal fluid cleaner comprising a vertical hollow shaft rigidly fixed to a base and having inlet and outlet conduits for the fluid and a cylindrical rotor rotatably mounted on the hollow shaft and encolosed by a casing, said rotor comprising a sleeve installed co-axially with the hollow shaft and carrying a band attached to the said sleeve at the inner end and coiled around the sleeve so that axial slots for passage of the fluid are formed by adjacent turns of the helical band and by spacers positioned between the band turns in parallel with the hollow shaft, and impellers arranged at both ends of the sleeve-and-band assembly, the lower impeller being located in the cavity communicating with the fluid inlet conduit in the hollow shaft and the upper one in the chamber communicating with the fluid outlet conduit in the hollow shaft; according to the invention the fluid inlet and outlet means are arranged in the upper part of the hollow shaft, the inlet conduit is connected with the cavity accommodating the lower impeller through an additional cavity formed between the casing and chamber upper wall and through an annular duct formed between the casing and peripheral turn of the helical band, said additional cavity being provided with an impeller installed co-axially with the shaft.

It is practical that the ribs of the impeller installed in the additional cavity be secured to the chamber outside wall preferably in an equispaced manner in circumference to ensure a reliable centering of the casing, reinforce the structure and simplify assembly of the rotor.

It is expedient that the lower part of the casing be detachable. The provision of a detachable lower part of the casing facilitates removal of sludge accumulated in the casing bottom part without disassembling the rotor.

It is advantageous to fit a ring-shaped part onto the periphery of the upper impeller, providing the part with holes for fluid passage and extending it close to the inside surface of the casing.

The provision of the ring-shaped part makes it possible to cleanse the casing inside surface of sticky contaminants having high adhesive capacity in the course of withdrawal of the sleeve-and-band assembly complete with the impellers from the casing.

The centrifugal fluid cleaner constructed according to the proposed invention is simple to operate and reliable in service and makes it possible to achieve better results in separating solid particles from polluted fluid.

BRIEF DESCRIPTION OF THE DRAWINGS

Given below is a detailed description of one preferred embodiment of the invention, in which reference will be made to the accompanying drawings, wherein.

DETAILED DESCRIPTION OF PREFERRED EMBODIMENT

Figures 1, 2:
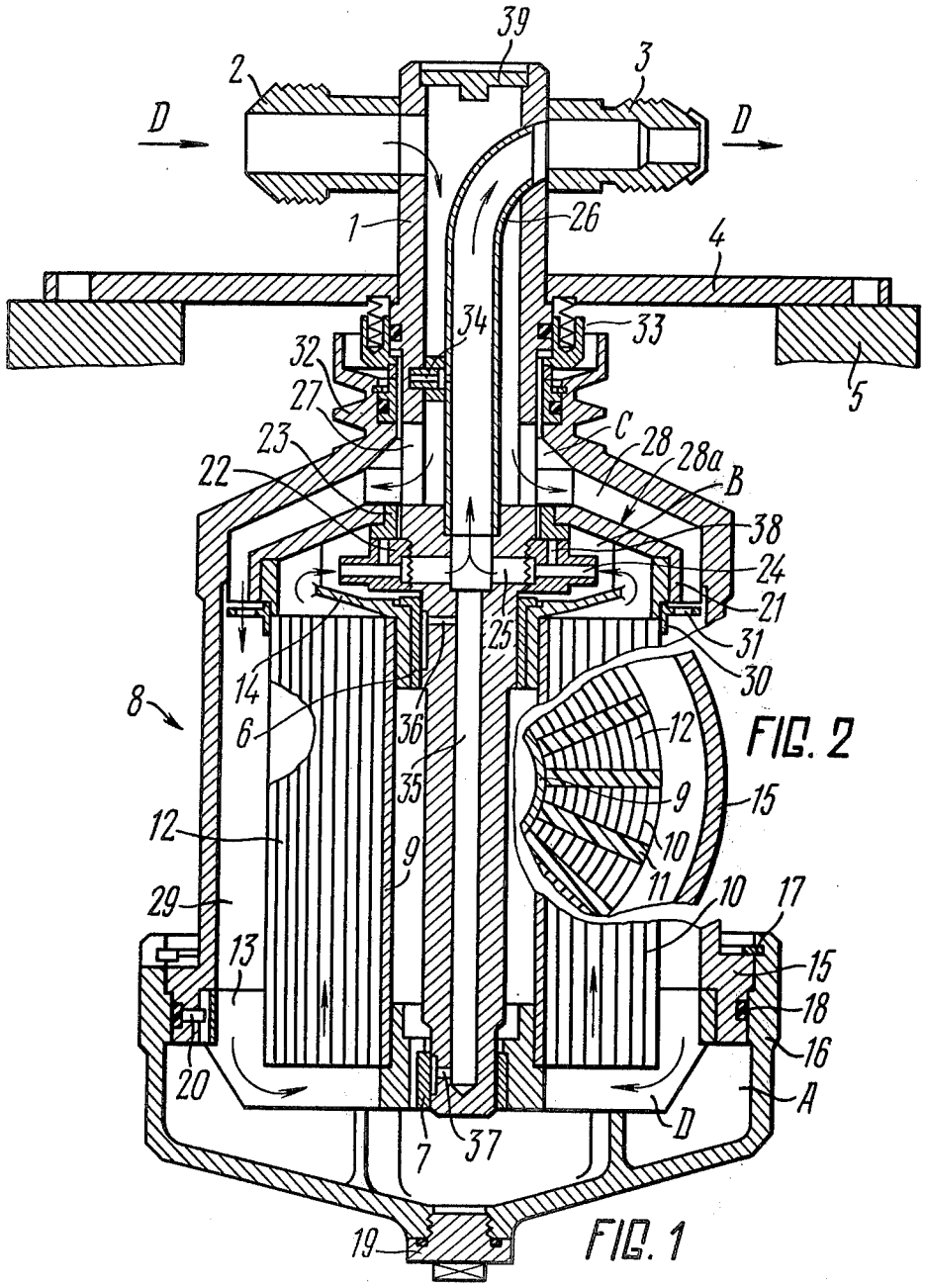
FIG. 1 is a vertical axial schematic section of the centrifugal fluid cleaner according to the invention.
FIG. 2 is a schematic fragmentary transverse section of this cleaner taken across the rotor.

The centrifugal fluid cleaner comprises a hollow shaft 1 (FIG. 1) provided with a connection 2 for the supply of the fluid into the hollow shaft 1 and with a connection 3 used for removal of the purified fluid. The centrifugal fluid cleaner is attached to a stationary base 5 through the medium of a flange 4 secured to the hollow shaft 1 which, in turn, carries a cylindrical rotor 8 adapted to revolve in suitable sliding bearings 6 and 7 so as to impart a gyratory movement to the fluid under purification. The rotor 8 comprises a sleeve 9 installed co-axially with the hollow shaft 1 and carrying a helical band 10 coiled around the said sleeve 9 and attached thereto at its inner end. A number of spacers 11 (FIG. 2) are installed in a radial array between adjacent turns of the helical band 10 in parallel with the hollow shaft. The spacers 11 and turns of the helical band 10 form axial slots 12 for conveyance of the fluid under cleaning. The slot radial size depends on the thickness of the spacers 11. Pressed into the sleeve 9 are impeller 13 (FIG. 1.) at the lower end and impeller 14 at the upper end. Impellers 13 and 14 are designed to promote the gyratory movement of the fluid and center the rotor 8 relative to the bearings 6 and 7. The sleeve 9 together with the helical band 10 and impellers 13 and 14 are enclosed in a fluid tight casing 15 whose lower part is detachable to serve as a cover 16 which is held in the closed position on the casing 15 by a locking ring 17. The joint between the cover and casing is made tight by a rubber gasket 18. The cover 16 has a bottom drain hole closed with a plug 19. The assembled lower impeller 13, sleeve 9 and upper impeller 14 are secured relative to the casing 15 by a key 20. Formed between the cover 16 and bottom end face of the sleeve-and-band assembly 9–10 is cavity "A" accommodating the impeller 13.

Chamber "B" accommodating the impeller 14 and a pressure disk 22 is formed by the top end face of the sleeve-and-band assembly 9–10 and a cover 21. The function of the pressure disk 22 secured to the hollow shaft is to build up pressure in the fluid expulsion line. A thrust bearing 23 abuts against the pressure disk on the top. The pressure disk 22 has passages 24 communicating chamber "B" via openings 25 in the hollow shaft 1 with a pipe 26 whose upper end is brought into the outlet connection 3.

The cover 21 is arranged so that an additional cavity "C" is formed between the cover and casing 15, said cavity being connected with the interior of the hollow shaft 1 via openings 27.

Secured onto the outside surface of the cover 21 are ribs 28 equispaced in circumference. The cover 21 and ribs 28 make up an entry impeller 28*a* located in the cavity "C". The incoming fluid flows from the cavity "C" downwards into the cavity "A" through an annular duct 29 formed between the casing 15 and peripheral turn of the helical band 10.

Fixed on the impeller 14 is a ring-shaped part 30 provided with a plurality of holes 31 to permit passage of the fluid. The periphery of the ring-shaped part is close to the inside surface of the casing 15 to serve as a scraper for removal of sludge from the inside surface of the casing 15 during detachment of the sleeve-and-band assembly 9–10 and impellers 13 and 14 from the shaft 1. A pulley 32 for a grooved belt (not shown) is made in the upper part of the casing 15 to impart rotation to the rotor 8 from a drive (not herein illustrated). To preclude leakage of fluid from the rotor 8 use is made of an end sealing 33 installed in the upper part of the casing 15 and communicating with the pipe 26 through a passage 34. The bearings 6, 7 and 23 are lubricated with decontaminated fluid supplied through respective suitable passages 35, 36, 37 and 38. The hollow shaft 1 is closed with a plug 39 on the top.

The centrifugal fluid cleaner operates as follows.

The mixture of fluid and solid particles flows via the connection 2 and openings 27 in the hollow shaft 1 into the cavity "C", wherein it is subjected to a gyratory movement under the effect of the ribs 28 to get further into the annular duct 29. The flow arrows "D" indicate the direction of fluid flow within the cleaner. The preliminary separation of polluting or contaminating matter from the fluid takes place in the annular duct 29. Larger solid particles stick to the inside surface of the casing 15, while the fluid flows via the cavity "A" into the slots 12 in the helical band 10 for further purification. As the fluid flows upwards along the slots 12, smaller solid particles are thrown onto the surfaces of the band 10, while purified fluid finds its way into the chamber "B", wherefrom it is drawn off by the pressure disk 22 to be forced under pressure through passages 24, openings 25 in the hollow shaft 1, pipe 26 and connection 3 to the fluid consumer.

The provision of the ribs 28 on the cover 21 and of the annular duct 29 at the periphery of the rotor offers a possibility to separate in average within 95–98% of the total mass of solid particles originally contained in the polluted fluid. The width of the annular duct 29 is to be selected so that the duct gets blocked up by the collected solid particles sooner, than the slots 12 are clogged by sludge, which makes it possible to maintain a high degree of fluid purification in the centrifugal cleaner throughout its operation cycle.

After the rotor comes to rest the accumulated sludge creeps downwards under gravity into the cover 16 of the casing 15 to be further removed after draining of the fluid from the rotor 8 and detachment of the cover. If need arises to clean the rotor thoroughly, sleeve 9 is pulled off the hollow shaft 1 together with the helical band 10 and impellers 13 and 14, in in which case the ring-shaped part 30 scrapes down the remainder of the sludge having a high adhesive capacity from the inside surface of the casing 15.

To ensure normal operation of the centrifugal cleaner, bearings 6, 7, 23 and seal 33 are lubricated with purified fluid fed under pressure via passages 35, 36, 37, 38 and 34. When the rotor is at a standstill, sludge cannot get into the bearings and seal, thus ensuring a durable and reliable operation of the cleaner.

The arrangment of the fluid outlet in the upper part of the hollow shaft 1 promotes the escape of air from the chamber "B" in priming and starting of the centrifugal cleaner through passages 24 in the pressure disk 22, opening 25 in the hollow shaft 1, pipe 26 and connection 3 under the effect of the raising fluid, thus requiring no special priming operations.

At a rotor speed of 8000 rpm and a fluid flow rate up to 40 l/min the described centrifugal fluid cleaner is capable of purifying the working fluid from abrasive solid particles down to 1–3 microns in size, maintaining high efficiency of purification throughout the operating cycle.

It takes little time (5–7 min) to remove sludge accumulated in the rotor (1.5 to 2.0 kg). The cleaner is simple in construction and dependable in operation.

What we claim is:

1. A centrifugal fluid cleaner comprising: a base, a hollow shaft positioned vertically, fixed rigidly to said base and provided with conduits for the supply and removal of fluid arranged in the shaft upper part; a cylindrical rotor rotatably mounted on said hollow shaft; a drive to impart rotation to said cylindrical rotor consisting of a sleeve coaxial with said hollow shaft, an upper impeller press-fitted into said sleeve at the upper end and intended to accelerate a gyratory movement of the fluid, a lower impeller fitted into the said sleeve at the lower end and designed to promote the gyratory movement of the fluid, a band attached at one end to said sleeve and coiled around it in a helical manner, spacers installed in a radial array between adjacent turns of said helical band preferably in parallel with said hollow shaft, slots for conveyance of working fluid, said slots being formed by said spacers and said helical band, a casing secured to said upper and lower impellers and enclosing said sleeve-and-band assembly and said upper and lower impellers; a cavity in said casing, which is formed between the casing lower part and bottom end face of said band-and-sleeve assembly and used to accommodate said lower impeller, a chamber formed in said casing for accommodation of said upper impeller and communicating with the outlet conduit in said hollow shaft, an additional cavity formed between said casing and said chamber and communicating with the inlet conduit in said hollow shaft, an annular duct formed between said casing and the peripheral turn of said helical band and providing communication of said additional cavity with said lower cavity; an impeller made in said additional cavity; a pressure disk mounted on said hollow shaft within said chamber, whose function is to transfer the purified fluid into the expulsion line.

2. A centrifugal fluid cleaner according to claim 1, wherein said ribs of the impeller installed in the additional cavity are secured on the outside surface of the upper wall of said chamber in an equally spaced manner in circumference.

3. A centrifugal fluid cleaner according to claim 1, wherein said bottom part of the casing is made detachable.

4. A centrifugal fluid cleaner according to claim 3, wherein a ring-shaped part with holes for passage of fluid is fitted onto the periphery of the upper impeller, said part being extended close to the inside surface of said casing.

* * * * *